US006482033B2

(12) United States Patent
Togashi et al.

(10) Patent No.: US 6,482,033 B2
(45) Date of Patent: Nov. 19, 2002

(54) COAXIAL CABLE CONNECTOR PLUG

(75) Inventors: Koji Togashi, Tokyo (JP); Takayoshi Endo, Shizuoka (JP); Kazuaki Sakurai, Shizuoka (JP)

(73) Assignees: SMK Corporation, Tokyo (JP); Yazaki Corporation, Tokyo (JP)

( * ) Notice: Subject to any disclaimer, the term of this patent is extended or adjusted under 35 U.S.C. 154(b) by 0 days.

(21) Appl. No.: 09/849,222

(22) Filed: May 7, 2001

(65) Prior Publication Data

US 2001/0053629 A1 Dec. 20, 2001

(30) Foreign Application Priority Data

May 8, 2000 (JP) ..... 2000-134925

(51) Int. Cl.[7] ..... H01R 9/05
(52) U.S. Cl. ..... 439/578; 439/460
(58) Field of Search ..... 439/578, 449, 439/452, 460, 595, 584, 585, 581

(56) References Cited

U.S. PATENT DOCUMENTS 3,828,305 A * 8/1974 Hogendobler ..... 439/585
4,070,751 A * 1/1978 Hogendobler et al. ..... 29/418
4,787,864 A * 11/1988 Hunt et al. ..... 439/595
5,931,698 A * 8/1999 Kodama ..... 439/578
5,975,950 A * 11/1999 Yamaguchi ..... 439/585
6,183,299 B1 * 2/2001 Ward et al. ..... 439/595
6,210,223 B1 * 4/2001 Aoyama et al. ..... 439/585

FOREIGN PATENT DOCUMENTS

JP 10-334998 * 12/1998 ..... H01R/13/648

* cited by examiner

*Primary Examiner*—Gary Paumen
*Assistant Examiner*—James R. Harvey
(74) *Attorney, Agent, or Firm*—Wenderoth, Lind & Ponack, L.L.P.

(57) ABSTRACT

A coaxial cable connector plug includes a connector body having the end of a coaxial cable fixed therein and a housing having an insertion hole to accommodate the connector body. The housing has a cantilever-like engagement nail extending in the insertion hole, thereby permitting the connector body to be caught by a frusto-conical transition in the insertion hole. The housing has a catch hole made in the vicinity of the cable-inlet of the housing. When a wedge-like retainer is inserted into the remaining space between the connector body and the floor of the housing, the wedge-like retainer is caught by the hook end, thus filling the remaining space and making the coaxial cable tightly retained in the housing. With this arrangement, the connector body can be removed from the housing so as to be reused.

8 Claims, 10 Drawing Sheets

COAXIAL CABLE CONNECTOR PLUG

BACKGROUND OF THE INVENTION

1. Field of the Invention

The present invention relates to an improvement in a coaxial cable connector plug which is connected to the end of a length of coaxial cable, and a method of making the same.

2. Related Arts

Referring to FIG. 21, a multi-connector 10 comprises low-frequency and high-frequency connector sections both packaged in a common casing. The coaxial connector plug 11 constitutes the high-frequency connector section, which can be improved according to the present invention.

The coaxial connector plug 11 has a connector body 14 (see FIG. 21) press-fitted in its plug case 12. A rectangular connector base 15 is applied to the coaxial connector plug 11 for connection to an associated apparatus.

The connector base 15 has an insertion hole 16 made therein. The insertion hole 16 is somewhat larger than the plug-insertion hole 13 of the plug case 12. The insertion hole 16 of the connector base 15 is center-aligned with the plug-insertion hole 13 of the coaxial connector plug 11, and the contact end of the connector body 14 is allowed to project in the insertion hole 16 of the connector base 15.

An engagement sleeve 17 is press-fitted in the plug-insertion hole 13 of the plug case 12. As shown in FIG. 23, the engagement sleeve 17 is circular, and the diameter of the cylindrical space is changed to define different sections as follows: an engagement sleeve section 18 of inner diameter "d1" extends a distance "L1" from one end of the engagement sleeve 17; a guide sleeve section 19 of inner diameter "d2" (="d1") extends a distance "L2" from the other end of the engagement sleeve 17; and a slope-and-plateau section 20 of inner diameter "d3" (<"d1") is formed in the transition from the guide sleeve section 19 to the engagement sleeve section 18. The slope-and-plateau section 20 has its conical surface 21 diverging toward the guide sleeve section 19.

As shown in FIG. 22, the connector body 14 has its cylindrical insulator 24 enclosed with a metal holder 25. The cylindrical insulator 24 has a pin 23 inserted at its center, and the cylindrical insulator 24 is fixed to the base 22.

The metal holder 25 comprises an open-worked bottom section 26, two split semi-cylindrical sections 27 integrally connected to the bottom section 26, and converging spears 29A and 29B integrally connected to the split semi-cylindrical sections 27. The bottom fingers 26 grip the insulator 24, and the converging spears 29A and 29B are arranged circularly to defame a circular space for accommodating an antenna rod (not shown), which is used in transmitting and receiving wireless signals of high frequency.

Each semi-cylindrical section 27 has a lance 30 or 31 cut and raised therefrom. The coaxial cable 32 is fixed to the open-worked bottom section 26 by a fastening member 33. The core conductor of the coaxial cable 32 is connected to the pin 23, and the outer shield of the coaxial cable 32 is connected to the metal holder 25.

As described above, the engagement sleeve 17 is fixed in the coaxial connector plug 11. The connector body 14 is inserted in the insertion hole 13 of the coaxial connector plug 11, and in the engagement sleeve 17, allowing the lances 33, 31 to be yieldingly bent when passing through the slope-and-plateau transition 20 of inner diameter "d3", and then allowing the lances 30 and 31 to return to their stress-free positions when appearing in the engagement section 18 of inner diameter "d1". Thus, the lances 30 and 31 are caught by the slope-and-plateau transition 20 so that the lances 30 and 31 may prevent the connector body 14 from being removed from the coaxial connector plug 11.

As described above, the lances 30 and 31 are cut and raised from the semi-cylindrical sections 27, thus leaving openings thereon to allow leakage of high-frequency electromagnetic wave from the openings of the semi-cylindrical sections 27. Accordingly the shielding effect is lowered. Also, disadvantageously once the connector body 14 has been inserted into the engagement sleeve 17, it cannot be pulled out without destroying the connector body 14. Therefore, the connector body 14 cannot be reused.

SUMMARY OF THE INVENTION

One object of the present invention is to provide a coaxial cable connector plug which is free of the defects as described above.

To attain this object a coaxial cable connector plug comprising a connector body having the end of a coaxial cable fixed therein and a housing having an insertion hole to accommodate the connector body. According to the present invention, the housing has a cantilever-like engagement nail extending in the insertion hole, thereby permitting the connector body to be caught in the insertion hole.

The cantilever-like engagement nail extends toward the inlet of the housing. The housing has a catch hole made in the vicinity of the inlet of the housing, whereby a wedge-like retainer may be caught by a detent when inserted into the space between the connector body and the floor of the housing, thereby fixedly holding the coaxial cable. The housing also has guide slots made in the opposite walls of the housing. The connector body is fixedly held in the housing by allowing the cantilever-like nail and the wedge-like retainer to catch selected parts (i.e., shoulders) of the connector body.

The connector body comprises: a shelled assembly comprising an insulator member having a contact piece inserted into its center hole, the contact piece being connected to the core conductor of the coaxial cable, and a metal shell enclosing the insulator member. A metal sleeve fitted on the coaxial cable makes an electric connection between the outer conductor of the coaxial cable and the metal shell. The connector body is caught by the transition formed from the metal sleeve to the metal shell by the cantilever-like nail. The transition formed from the metal sleeve to the metal shell is defamed to be a conical surface. With the above-described arrangement the electric shielding effect is substantially improved, and the connector body can be reused after bing removed from the connector plug housing.

A method of making a coaxial cable connector plug according to the present invention comprises preparing a cylindrical assembly comprising a metal hollow cylinder shell having an insulator cylinder press-fitted therein, and a length of coaxial cable having a contact piece crimped on its core conductor. The contact piece and subsequent cable length of the coaxial cable is inserted into the cylindrical assembly, and the subsequent cable length-and-overlying cylindrical part is inserted into a metal sleeve to provide a connector body. The connector body is inserted into a housing, and a wedge-like retainer is inserted into the space left between the connector body and the housing floor.

Other objects and advantages of the present invention will be understood from the following description of a coaxial cable connector plug according to one preferred embodiment of the present invention, which is shown in accompanying drawings:

DETAILED DESCRIPTION OF THE INVENTION

Figure 1:
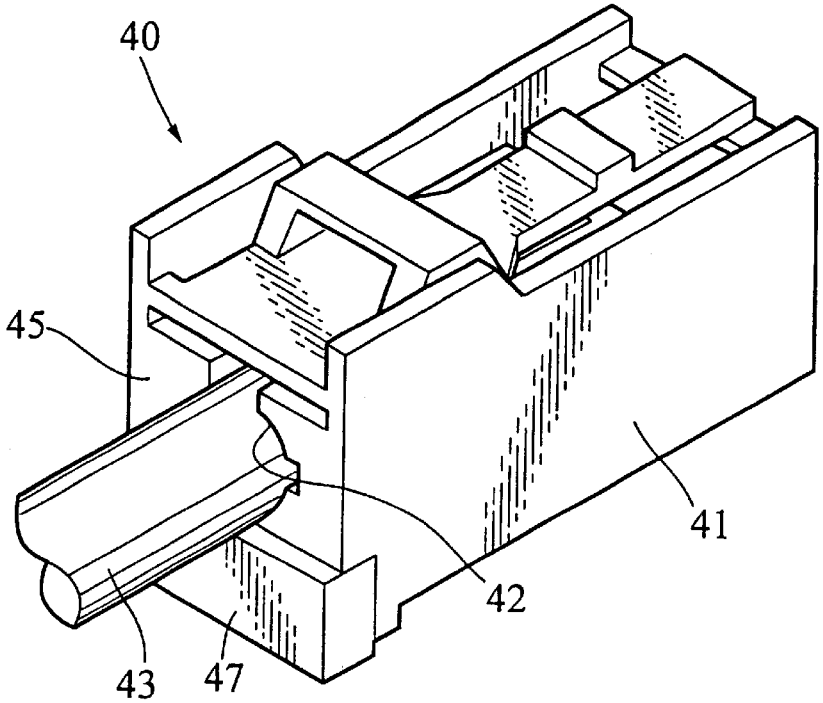
FIG. 1 is a perspective view of a coaxial cable connector plug.
Figure 2:
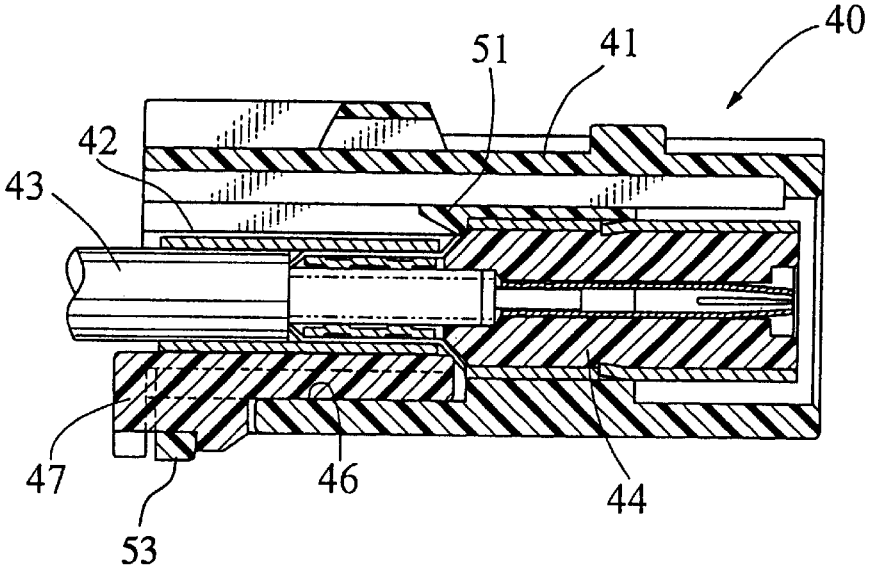
FIG. 2 is a longitudinal section of the coaxial cable connector plug.

Referring to FIGS. 1 and 2, a coaxial cable connector plug 40 comprises a connector body 44 having the end of a coaxial cable 43 fixed therein, a rectangular box-like housing 41 having a circular insertion hole 42 to accommodate the connector body 44, and a wedge-like retainer 47 inserted in the remaining space of the housing 41 to hold the connector body 44 firmly in the housing 41.

Figure 3:
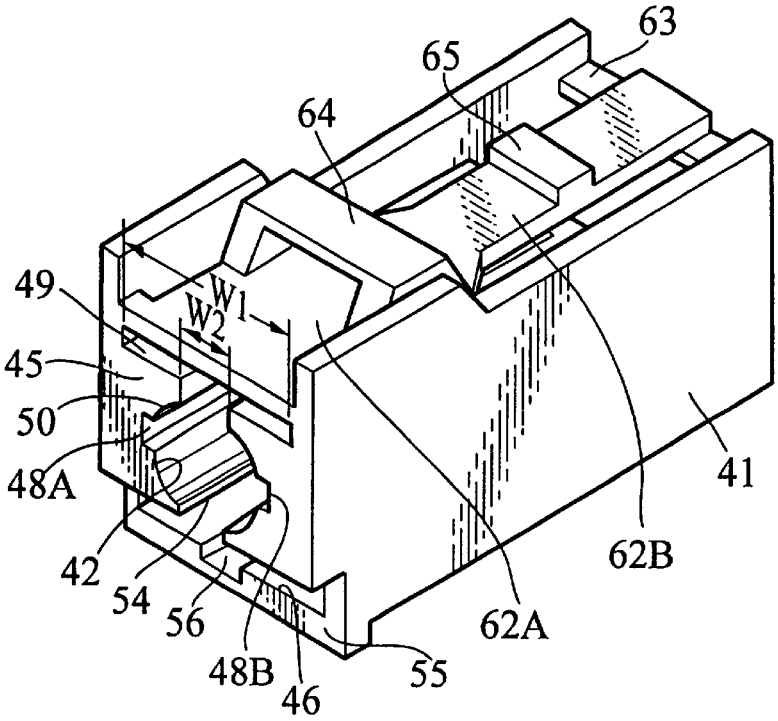
FIG. 3 is a perspective view of the housing of the coaxial cable connector plug.
Figure 4:
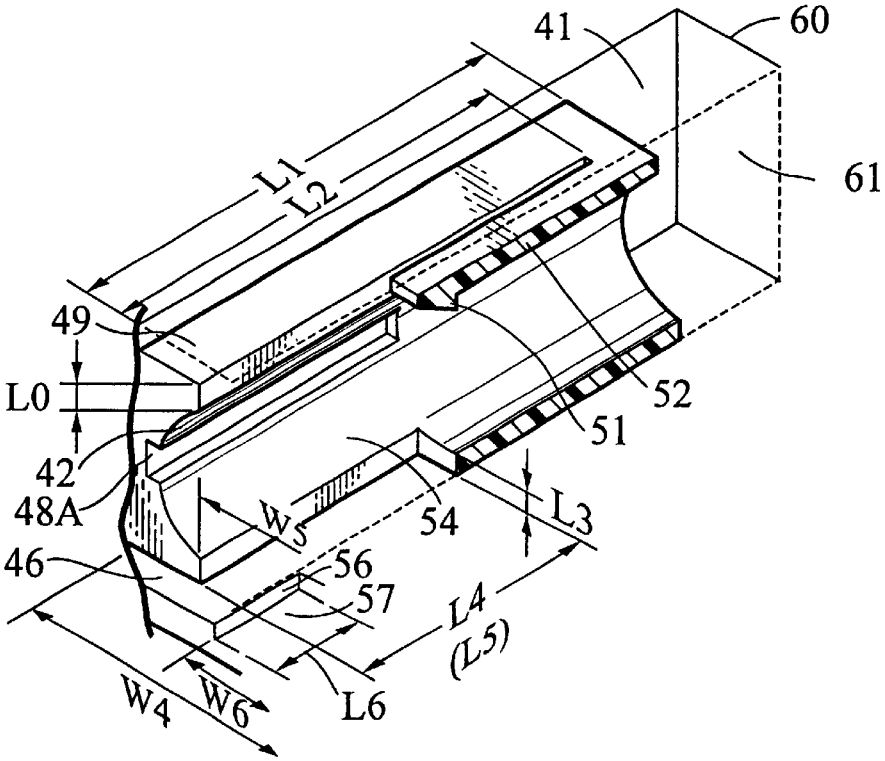
FIG. 4 is a perspective view of the left half of the housing taken along the longitudinal center line, showing the inner part in the vicinity of the entrance of the insertion hole.
Figure 5:
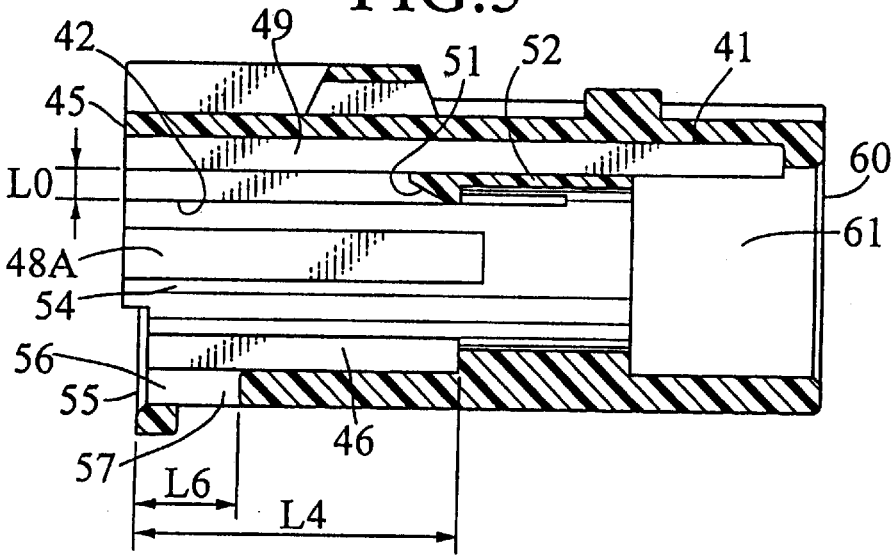
FIG. 5 is a longitudinal section of the housing.

Referring to FIGS. 3 to 5, the housing 41 has the circular insertion hole 42 at its center, and it further has a pair of lateral guide slots 48A and 48B on the opposite lateral sides of the circular insertion hole 42. These guide slots 48A and 48B extend a predetermined length in the longitudinal direction of housing 41 to control the insertion of the connector body 44 in the housing 41.

The housing 41 further has an upper horizontal slot 49 and an adjoining vertical slot 50 made therein. The horizontal slot 49 is a predetermined width "W1" wide, a predetermined length "L1" long, and a predetermined distance "L0" above the circular insertion hole 42, whereas the vertical slot 50 is a predetennined width "W2" wide ("W"2 <"W1"), and a predetermined length "L2" long ("L"2 <"L1"), and allows communication of the circular insertion hole 42 with the horizontal slot 49. Thus, the horizontal-and-vertical slot combination is like a flattened "T" shape.

The housing 41 has a cantilever-like engagement beam 52 extending in the vertical slot 50 toward the cable-inlet side of the housing 41. The cantilever-like engagement beam 52 is integrally connected to the dead end of the vertical slot 50, and it has a catch nail 51 formed at its free end. The catch nail 51 is a ramp-shaped piece, and the cantilever-like engagement beam 52 is "L0" thick.

The cantilever-like engagement beam 52 is formed of a resilient material such as a plastic material. Therefore, the insertion of the connector body 44 into the insertion hole 42 makes the cantilever-like engagement beam 52 yieldingly bend upwards, thereby permitting the connector body 44 to be fitted in the housing 41. When the connector body 44 is press-fitted in the housing 41, the cantilever-like engagement beam 52 returns to its initial, stress-free position to grip the connector body 44 with its nail 51, thus preventing the slipping-off of the connector body 44 from the housing 41.

As seen from FIGS. 4 and 5, the housing 41 has a notched section 55 formed on its lowermost front edge, and a flattened "T"-shaped retainer slot is made longitudinally in the notched section 55. Also, a slit opening 54 is made to allow communication of the flattened "T"-shaped retainer slot with the insertion hole 42. Specifically, the flattened "T"-shaped retainer slot is composed of a relatively wide, horizontal slot section 46 and an adjoining relatively narrow vertical slot section 56. The horizontal slot section 46 is a predetermined distance "L3" apart downwards from the circular insertion hole 42, and is a predetermined width "W4" wide and a predetermined length "L4" long, whereas the vertical slot section 56 is a predetermined width "W6" wide and a predetermined length "L6" long. The slit opening 54 is a predetermined width "W5" wide ("W"5 <"W4"), and a predetermined length "L5" long ("L"5 ="L4"). The vertical slot section 56 has a catch hole 57 on the bottom of the housing 41. When the wedge-like retainer 47 is inserted in the flattened "T"-shaped retainer slot, the hook 58 of the wedge-like retainer 59 can be caught by the catch hole 57.

Figure 6:
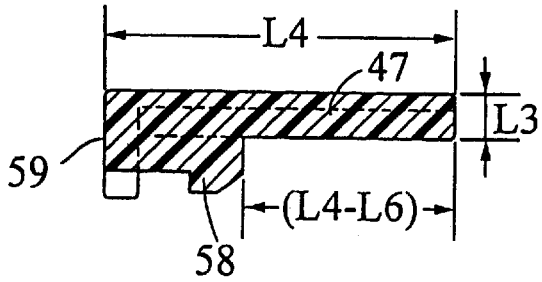
FIG. 6 is a longitudinal section of a wedge-like retainer to be inserted in the retainer slot of the housing.

Referring to FIG. 6, the wedge-like retainer 47 is the same width "W4" wide, and the same length "L4" long as the retainer slot 46, and the slot formed which is the length (L4–L6) measured from the rear end of the wedge-like retainer 47 is the thickness "L3" thick. The ramp-shaped catch hook 58 is formed ahead of the slot having the length (L4–L6) measured from the rear end of the wedge-like retainer 47, and the remaining portion to the front end 55 is the height of the flattened "T"-shaped retainer slot (the total size of the horizontal slot section 46 plus the vertical slot section 56) thick to be ended with the downward extension as a thumb push 59.

The wedge-like retainer 47 is press-fitted in the flattened "T"-shaped retainer slot with the hook 58 caught by the catch hole 57 against detent 53, thereby filling the remaining space between the coaxial cable 43 and the housing 41 to hold the coaxial cable 43 firmly in the housing 41. At the same time, the catch nail 51 and the retainer 47 prevent the connector body 44 from slipping from the housing 41 as described later.

The wedge-like retainer 47 can be easily removed from the housing 41 simply by pushing up the hook 58 in the catch hole 57. When the wedge-like retainer 47 is removed, the coaxial cable 43 is so loosely retained in the insertion hole 42 that the connector body 44 may be disengaged from the catch nail 51 of the cantilever-like beam 52. Thus, the housing 41 and the connector body 44 can be reused.

As seen from FIG. 5, the housing 41 has a rectangular space 61 formed at its rear end 60, and the rectangular space 61 is allotted to the contact section for a desired device.

As seen from FIG. 3, the ceiling plate 62A is integrally connected at its front end to the opposite side walls of the housing 41, and is connected at its rear end to a transverse beam 63, which is integrally connected to the opposite side walls of the housing 41. A bridge-like traverse 64 crosses over the ceiling plate 62A, and the ceiling plate 62A has a reduced width over its extension 62B between the bridge-like traverse 64 and the transverse beam 63. A plateau 65 is formed on the narrow extension 62B of the ceiling plate 62A.

Figure 7:
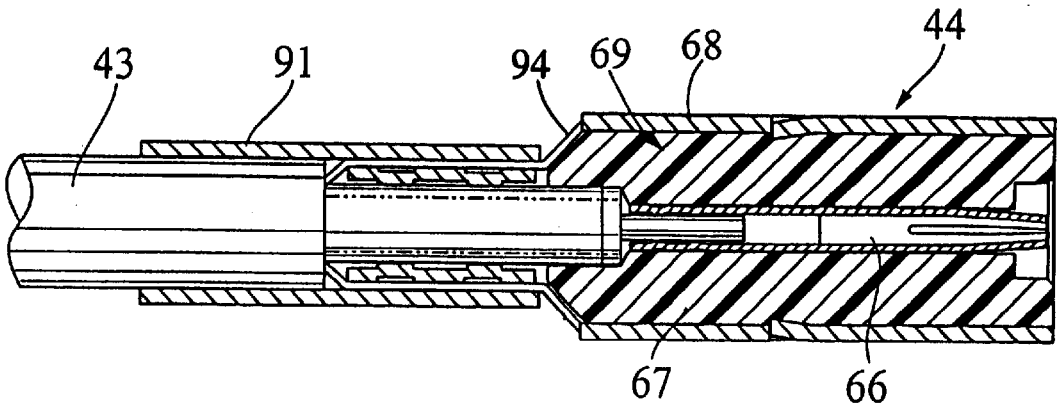
FIG. 7 is a longitudinal section of a connector body to be inserted in the housing.

FIGS. 7 to 12 show the connector body 44 and the parts of the connector body 44. As shown in FIG. 7, the connector body 44 comprises a shelled assembly 69 and a metal sleeve 91 connected at shoulder portion 94. The shelled assembly 69 comprises an insulator member 67 having a split contact piece 66 inserted into its center hole, and a metal shell 68 enclosing the insulator member 67. The split contact piece 66 is connected to the core conductor of the coaxial cable 43. The metal sleeve 91 is fitted on the coaxial cable 43 to make an electric connection between the outer braided conductor 83 of the coaxial cable 43 and the metal shell 68.

Figure 8:
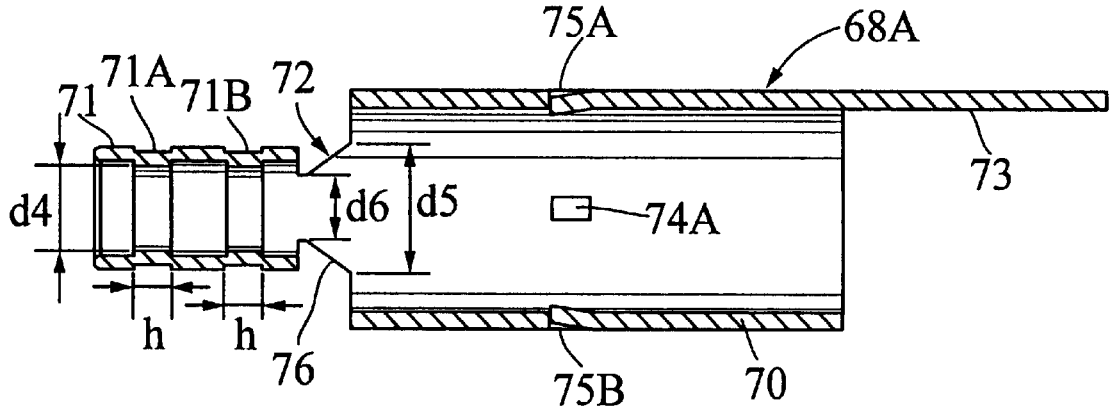
FIG. 8 is a longitudinal section of a metal shell which constitutes a part of the connector body.

As seen from FIG. 8, the metal shell 68A comprises a relatively large cylindrical section 70, a relatively small cylindrical section 71, and a frusto-conical transition 72 from the relatively large cylindrical section 70 to the relatively small cylindrical section 71. These sections and transition are integrally connected to each other, and are made of metal.

As seen from the drawing, the relatively large cylindrical section 70 has a carrier piece 73 made in the form of longitudinal extension having an arc shape in cross section. Also, the relatively large cylindrical section 70 has a pair of rectangular projections 74A and 74B (projection 74B not being shown) and hook-like indents 75A and 75B formed on its cylindrical surface. The rectangular projections 74A and 74B are formed by raising selected places in the cylindrical surface so as to allow them to fit in the guide slots 48A and 48B of the insertion hole 42 of the housing 41 when the connector body 44 is inserted in the housing 41.

The relatively small cylindrical section 71 has two crimped sections 71A and 71B formed therein, thereby preventing the coaxial cable 43 from slipping off by applying friction force to the coaxial cable 43 once inserted into the relatively small cylindrical section 71. Each crimped section has a width "h" and an inner diameter "d4".

The frusto-conical transition from the relatively large cylindrical section 70 to the relatively small cylindrical section 71 is formed as follows: the relatively large cylindrical section 70 has an annular end of reduced diameter "d5" on its cable-inlet side. The center circle of diameter "d5" converges to the frustum circle whose diameter "d6" is somewhat smaller than the diameter of the relatively small cylindrical section 71, thus defining the conical surface 76. The circle of diameter "d6" is then enlarged to the diameter of the relatively small cylindrical section 71 to be consecutive to the relatively small cylindrical section 71.

Figure 9:
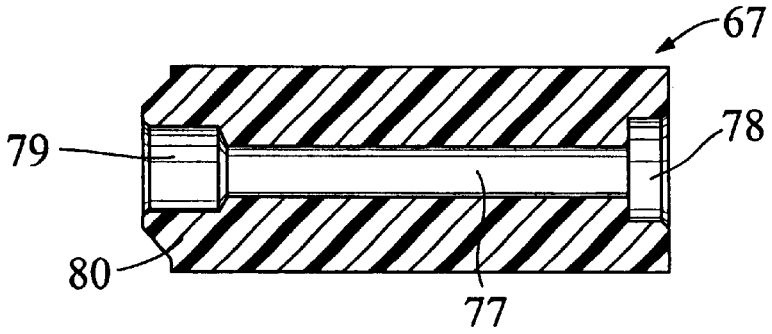
FIG. 9 is a longitudinal section of an insulator member which constitutes another part of the connector body.

As seen from FIG. 9, the insulator member 67 is a cylindrical body chamfered at one end, and the cylindrical body has a through hole 77 at its center. The converging surface 80 of the chamfered end conforms to the frusto-conical transition of the shell 68A. The chamfered cylindrical body has indentations 78 and 79 formed on its opposite ends.

Figure 10:
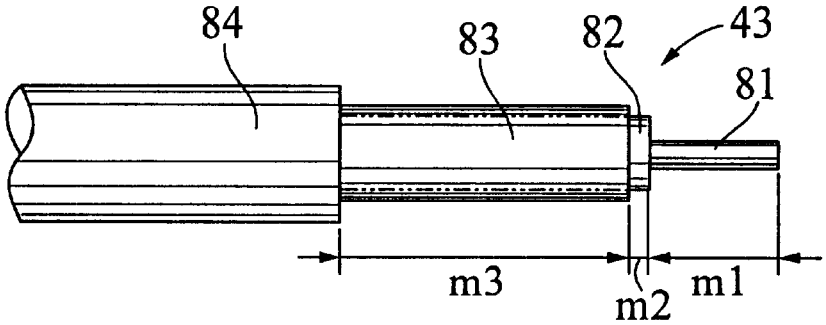
FIG. 10 shows the end of a coaxial cable.

As seen from FIG. 10, the coaxial cable 43 comprises a core conductor 81 covered by a insulator 82, an outer braided conductor 83 covering the insulator 82 for shielding the core conductor 81, and finally an insulator cover 84 (for instance, polyethylene) covering the outer braided conductor 83.

The end of the coaxial cable 43 is stripped to expose the part of core conductor 81 of length "m1", the part of insulator 82 of length "m2" and the part of outer braided electrical conductor 83 of length "m3", thereby facilitating the required connection of the coaxial cable 43 to the connector body 44.

Figure 11:
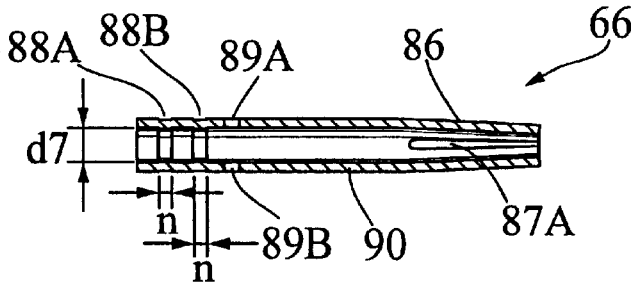
FIG. 11 is a longitudinal section of a contact piece which constitutes still another part of the connector body.

As seen from FIG. 11, the split contact piece 66 has a cylindrical-and-frusto-conical shape, and the fiusto-conical part (at the front end) is divided into separate splits 87A, 87B (split 87B not shown), thereby facilitating the insertion of an antenna rod. The split contact piece 66 has crimped portions 88A and 88B in the vicinity of the other (rear) end, thereby preventing the core conductor 81 of the coaxial cable 43 from slipping off from the contact piece 66. The split contact piece 66 has upper and lower holes 89A and 89B made forward of the crimped part 88B. The contact portion 90 from the holes 89A and 89B to the converging end is straight.

Figure 12:
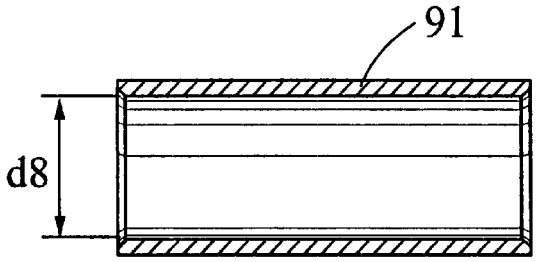
FIG. 12 is a longitudinal section of a metal sleeve which constitutes still another part of the connector body.

Referring to FIG. 12, the metal sleeve 91 is a metal cylindrical hollow body having an inner diameter equal to the outer diameter of the coaxial cable 43, and it has its opposite inner circumferences chamfered to facilitate the insertion of the coaxial cable 43.

Referring to FIGS. 13 to 20, the manner in which the parts of the connector body 44 (see FIGS. 8 to 12), and the housing 41 (see FIGS. 3 to 5) are assembled to a coaxial cable connector plug 40 is described below.

Figure 13:
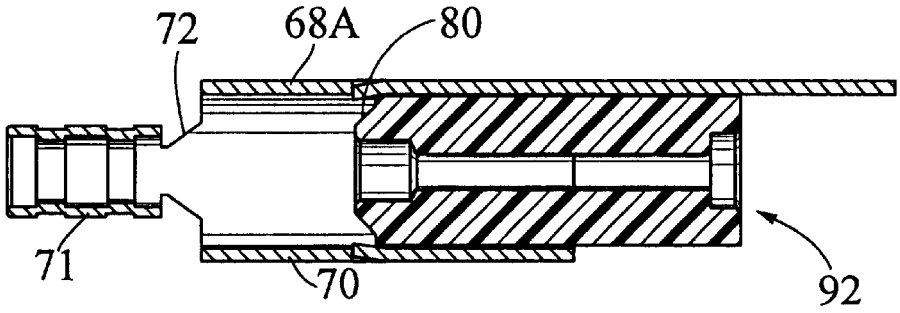
FIG. 13 is a longitudinal section of the metal shell and the insulator member in combination, illustrating how the insulator member is press-fitted in the metal shell at the press-fitting step to produce a connector body of FIG. 7.
Figure 14:
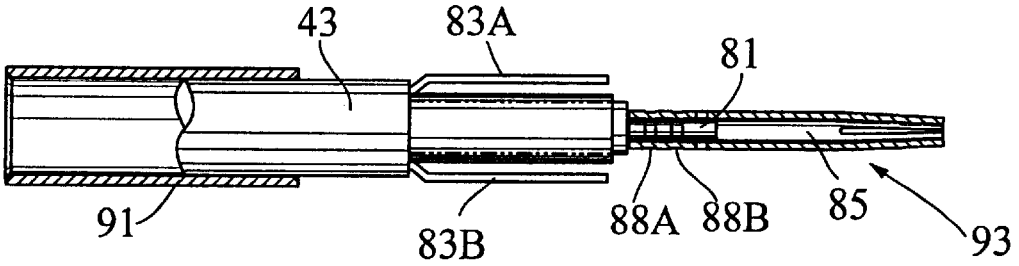
FIG. 14 is a longitudinal section of the metal sleeve and the coaxial cable in combination, illustrating how the coaxial cable is press-fitted in the sleeve at the combining step in producing the connector body.
Figure 15:
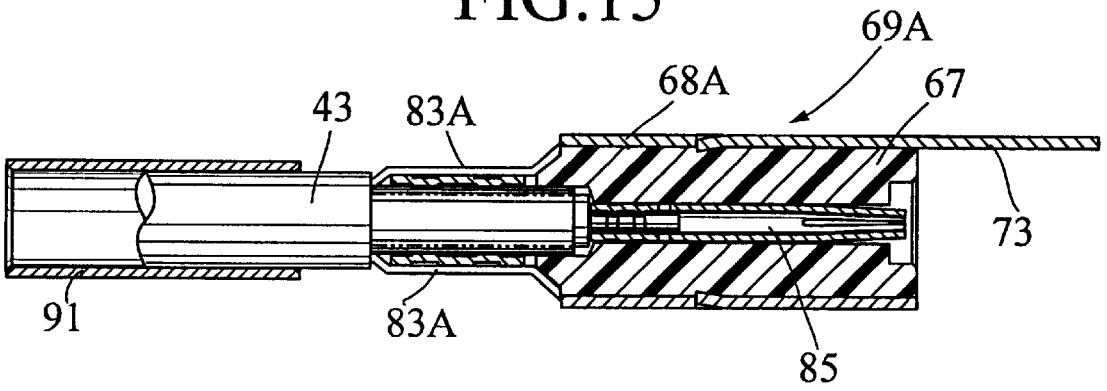
FIG. 15 is a longitudinal section of the sleeve-and-cable combination and the metal shell-and-insulator combination, illustrating how these parts are jointed at the jointing step in producing the connector body.
Figure 16:
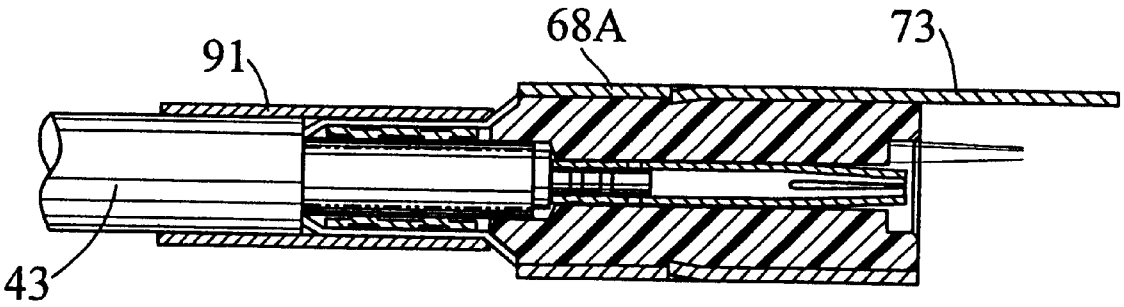
FIG. 16 is a longitudinal section of the sleeve-and-cable combination and the metal shell-and-insulator combination, illustrating how these parts are assembled at the assembling step 1 in producing the connector body.
Figure 17:
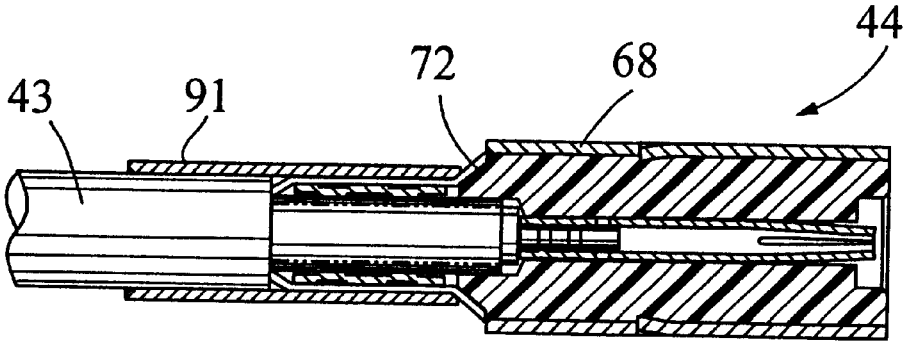
FIG. 17 is a longitudinal section of the sleeve-and-cable combination and the metal shell-and-insulator combination, illustrating how these parts are assembled at the assembling step 2 in producing the connector body.

The shelled assembly 69 can be provided after associated parts are assembled at subsequent steps shown in FIGS. 13 to 15. First, the insulator member 67 of FIG.9 is inserted in the relatively large cylindrical section 70 of the metal shell 68 until the converging end 80 of the insulator member 67 abuts the frusto-conical transition of the shell 68A at the press-fitting step (see FIG. 13). Thus, the shelled-cylindrical body 92 is provided.

The coaxial cable 43 is inserted in the sleeve 91 so that the front end of the sleeve 91 is behind the outer insulation stripped end of the coaxial cable 43. Then, the core conductor 81 of the coaxial cable 43 is inserted in the crimped parts 88A and 88B of the contact piece 85 so as to crimp the contact piece 66 to the core conductor 81 of the coaxial cable 43 at the connecting step (see FIG. 14).

Thereafter, the braided shield 83 is unbraided and divided into two separate divisions 83A and 83B, as seen from FIG. 14. The contact-and-cable combination of FIG. 14 is inserted into the relatively small cylindrical section 71 of the metal shell 68A until the contact piece 85 has been put in the through hole 77 of the insulator member 67 at the jointing step (see FIG. 15).

In this position the two unbraided divisions 83A and 83B are laid on the relatively small cylindrical section 71 of the metal shell 68A, and the sleeve 91 is moved forward to abut on the diverging transition of the metal shell 68A. Thus, a required electric connection between the braided outer electrical conductor 83 of the coaxial cable 43 and the metal shell 68A at the assembling step 1 (see FIG. 16) is formed. The carrier 73 is bent and removed from the shelled assembly 69A at the assembling step 2 (see FIG. 17). Then, the sleeve 91 is crimped to provide an integral cable-and-shell body. Thus, the connector body 44 of FIG. 7 is provided.

Figure 18:
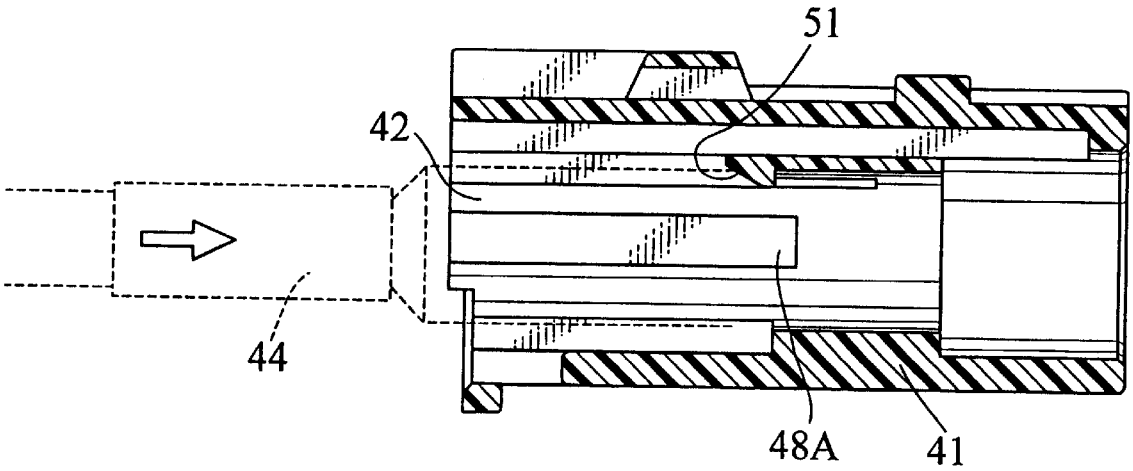
FIG. 18 is a longitudinal section of the connector body and the housing, illustrating how these parts are assembled at the final step 1.
Figure 19:
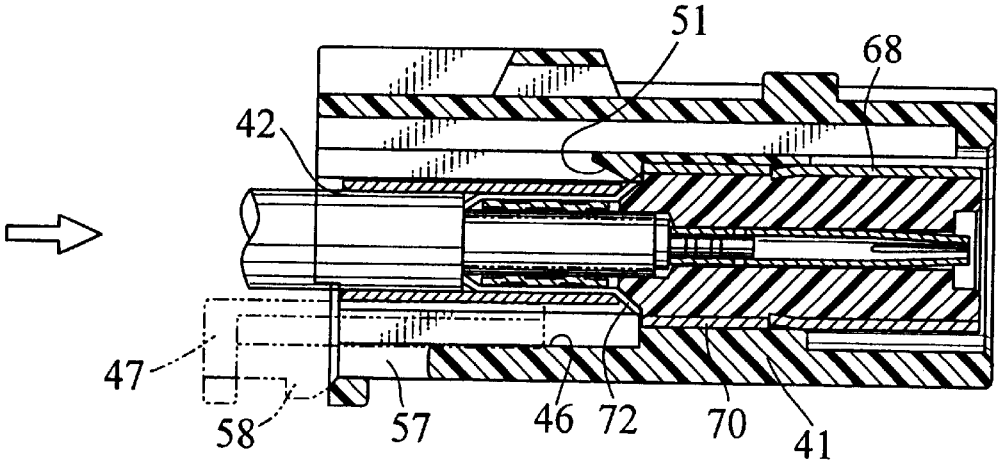
FIG. 19 is a longitudinal section of the connector body of FIG. 7 and the housing, illustrating how the wedge-like retainer is inserted at the final step 2.
Figure 20:
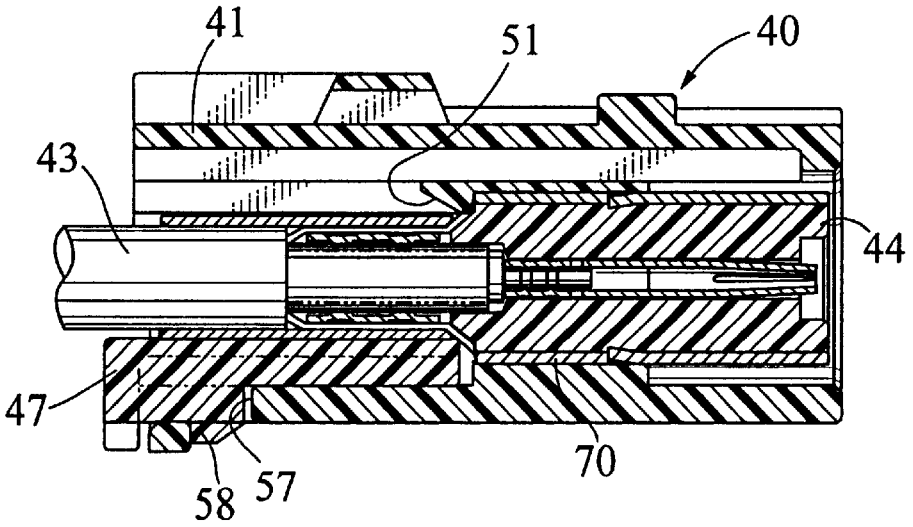
FIG. 20 is a longitudinal section of the connector body-and-housing assembly, illustrating how the complete coaxial cable connector plug is like (finished)
Figure 21:
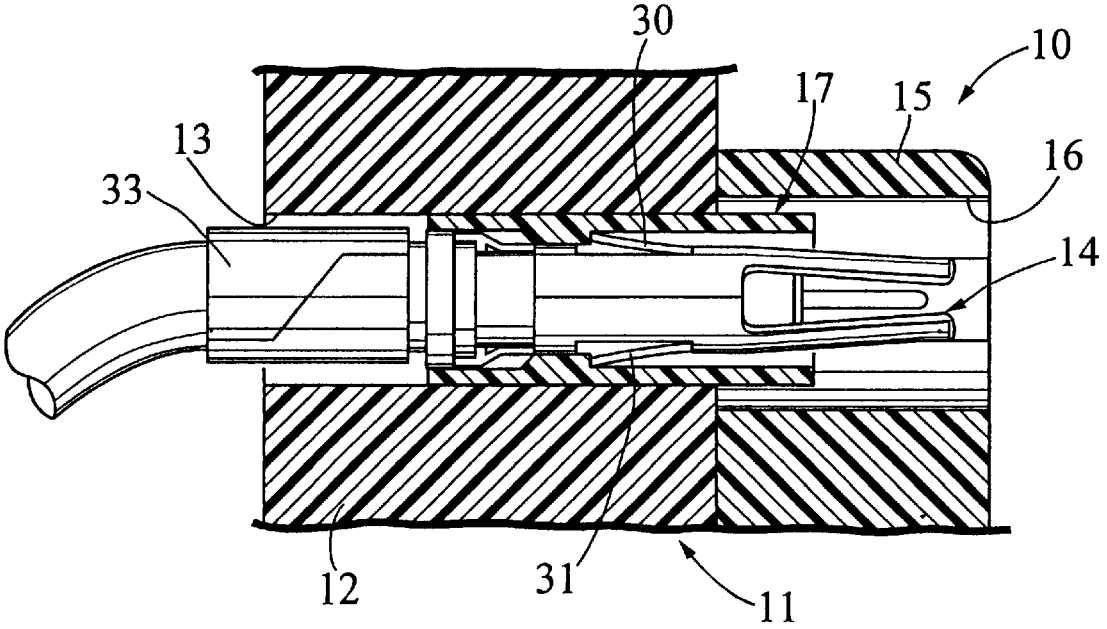
FIG.21 PRIOR ART
FIG. 21 is a longitudinal section of a conventional coaxial cable connector.

Referring to FIGS. 18 to 20, the connector body 44 is inserted in the insertion hole 42 of the housing 41 with the rectangular projections 74A and 74B of the connector body 44 put in the guide slots 48A and 48B of the insertion hole 42 of the housing 41 until the shoulder portion 94 (FIG. 7) of the connector body 44 has been caught by the hook end 51 of the cantilever-like beam 52. Thus, the connector body 44 is prevented from slipping from the casing 41 at the final step 1 (see FIG. 18).

The wedge-like retainer 47 of FIG. 6 is inserted in the flattened "T"-shaped retainer slot, allowing the ramp-shaped catch hook 58 to be caught by the detent 53 of the catch hole 57, thus making the coaxial cable 43 tightly retained in the housing 41. At the same time, the connector body 44 is prevented from supplying from housing 41 together with the hook end 51 of the cantilever-like beam 52 by pushing the frusto-conical transition of the connector body 44. Thus, the coaxial connector plug 40 is provided. The press-fitting step (FIG. 13) and the jointing step (FIG. 14) can be reversed in order.

Figure 22:
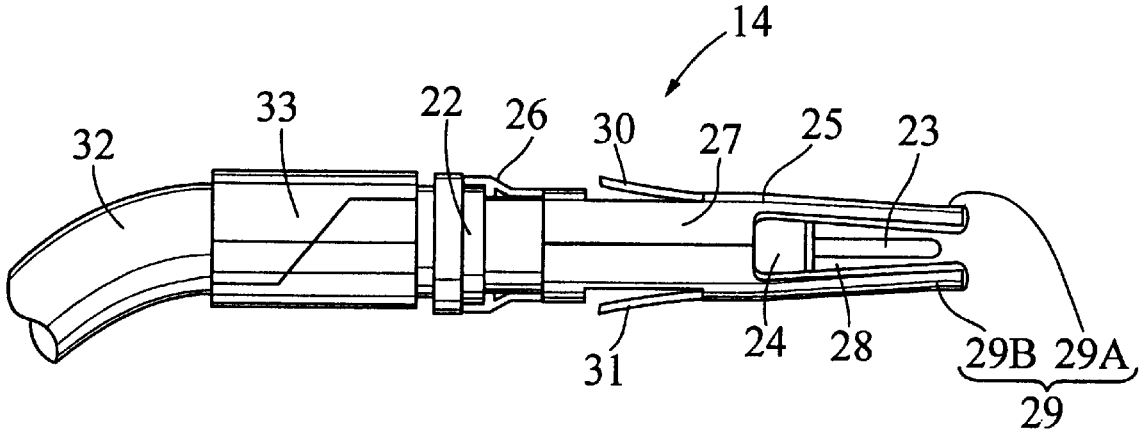
FIG.22 PRIOR ART
FIG. 22 is a side view of the connector body of the conventional coaxial cable connector.
Figure 23:
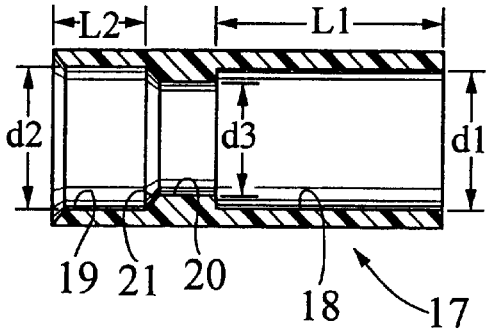
FIG.23 PRIOR ART
FIG. 23 is a longitudinal section of the engagement sleeve of the coaxial cable connector of FIG. 21.

As may be understood from the above, the core conductor of the coaxial cable is almost completely shielded, and is free of electromagnetic-transparent spaces such as in the lanced contact of the conventional coaxial cable-and-connector combination (FIG. 22), thus preventing the leakage of electromagnetic wave from the coaxial cable connection and the appearance of noise signals. Still advantageously even after the connector body has been inserted in the housing, the connector can be removed from the housing simply by removing the wedge-like retainer from the housing. Thus, the connector body can also be reused.

What is claimed is:

1. A coaxial cable connector plug comprising:

a connector body including an insulator member and a metal shell enclosing said insulator member, an end of the coaxial cable being inserted in said connector body such that said metal shell is connected to an outer electrical conductor of the coaxial cable, said connector body further including a metal sleeve fitted on said coaxial cable so as to surround said coaxial cable such that an electrical connection is formed between the outer electrical conductor and said metal shell;

a housing having:

an insertion hole for accommodating said connector body;

a cantilever beam extending along a first side of said insertion hole, said cantilever beam having a distal end nearest to an inlet end of said insertion hole and having a catch nail at said distal end for catching a shoulder portion of said connector body when said connector body is inserted in said housing;

a retainer slot extending along a second side of said insertion hole opposite said first side and being shaped so as to allow communication between said retainer slot and said insertion hole;

a catch hole formed in said housing at said inlet end of said insertion hole; and a detent formed between said catch hole and an inlet-side of said housing; and a wedge retainer to be press-fitted into said retainer slot of said housing, said wedge retainer having a catch hook and being shaped such that:

when said wedge retainer is press-fitted in said retainer slot, said wedge retainer has a leading end abutting against said shoulder portion of said connector body, a side surface pressing against said metal sleeve of said connector body, and said catch hook extends into said catch hole so as to abut against said detent, whereby said connector body is held in said insertion hole of said housing; and when said catch hook is pushed through said catch hole towards said insertion hole such that said catch hook is pushed off said detent, said wedge retainer can be removed from said retainer slot, whereby said shoulder portion of said connector body can be disengaged from said catch nail and said connector body can be removed from said housing.

2. The coaxial cable connector of claim 1, wherein said insulator member includes a center hole, said connector body further including a metal contact piece inserted in said center hole and connected to a core conductor portion of the coaxial cable inserted into said connector body.

3. The coaxial cable connector of claim 2, wherein said contact piece has a crimped base portion at a rear end, a split tip portion at a front end, and a straight contact portion between said base portion and said tip portion.

4. The coaxial cable connector of claim 1, wherein said catch hole is formed as a through-hole extending between said retainer slot and an outer surface of said housing in a radial direction with respect to said insertion hole.

5. The coaxial cable connector of claim 4, wherein when said wedge retainer is press-fitted in said retainer slot, a first side surface of said wedge retainer presses against said metal sleeve of said connector body, said catch hook projects outward from a second side surface of said wedge retainer opposite said first side surface so as to extend into said catch hole.

6. The coaxial cable connector of claim 1, wherein said housing guide slots formed in opposite walls of said insertion hole.

7. The coaxial cable connector of claim 6, wherein said metal shell has an outer surface and has projections extending from said outer surface, said projections being arranged so as to slide within said guide slots.

8. The coaxial cable connector of claim 1, wherein said metal shell is free of cutout portions.

* * * * *